US006004207A

United States Patent [19]

Wilson, Jr. et al.

[11] Patent Number: 6,004,207

[45] Date of Patent: Dec. 21, 1999

[54] SLOT MACHINE WITH INCREMENTAL PAY-OFF MULTIPLIER

[75] Inventors: Robert J. Wilson, Jr.; Benjamin T. Gomez; Alfred Thomas, all of Chicago, Ill.

[73] Assignee: WMS Gaming Inc., Chicago, Ill.

[21] Appl. No.: 08/998,139

[22] Filed: Dec. 23, 1997

[51] Int. Cl.[6] ..... A63F 9/24

[52] U.S. Cl. ..... 463/20; 273/143 R; 463/25

[58] Field of Search ..... 463/27, 26, 25, 463/20, 19, 18, 17, 16; 273/143 R

[56] References Cited

U.S. PATENT DOCUMENTS

| | | | |
|---|---|---|---|
| 4,624,459 | 11/1986 | Kaufman | 273/143 R |
| 4,721,307 | 1/1988 | Okada | 273/143 R |
| 5,116,055 | 5/1992 | Tracy | 463/20 X |
| 5,564,700 | 10/1996 | Celona | 463/20 X |
| 5,664,781 | 9/1997 | Feola | 273/292 |
| 5,697,843 | 12/1997 | Manship et al. | 463/20 |
| 5,848,932 | 12/1998 | Adams | 463/20 |
| 5,882,261 | 3/1999 | Adams | 463/20 |

FOREIGN PATENT DOCUMENTS

| | | | |
|---|---|---|---|
| 2096376 | 10/1982 | United Kingdom | G07F 17/34 |
| 2153572 | 8/1985 | United Kingdom | G07F 17/34 |
| 2204436 | 11/1998 | United Kingdom | G07F 17/34 |

OTHER PUBLICATIONS

"Pirate's Thunder" Game Brochure.

*Primary Examiner*—Michael O'Neill
*Attorney, Agent, or Firm*—Rudnick & Wolfe

[57] ABSTRACT

A spinning reel slot machine which gives a multiplied payoff when certain conditions are fulfilled. Wins including a special symbol on the pay line are multiplied by an incremental multiplier when the machine is in a particular mode. A counter value is increased by one every time a second special symbol appears on the visible sections of the reels. Whenever the counter reaches a predetermined value, the counter is reset and the multiplier is increased. Whenever a multiplied payout occurs, the multiplier is reset to a minimum value.

16 Claims, 8 Drawing Sheets

FIG. 3

| STOPS | REEL 1 | REEL 2 | REEL 3 |
|---|---|---|---|
| 1 | SEVEN | SEVEN | SEVEN |
| 2 | BLANK | BLANK | BLANK |
| 3 | 2BAR | 2BAR | 1BAR |
| 4 | BLANK | BLANK | BLANK |
| 5 | 1BAR | 1BAR | 2BAR |
| 6 | BLANK | BLANK | BLANK |
| 7 | 3BAR | 3BAR | 3BAR |
| 8 | BLANK | BLANK | BLANK |
| 9 | 2BAR | 2BAR | 1BAR |
| 10 | BLANKHI | BLANKHI | BLANK |
| 11 | POWERPOINT | POWERPOINT | XFACTOR |
| 12 | BLANKLO | BLANKLO | BLANK |
| 13 | 1BAR | 1BAR | 2BAR |
| 14 | BLANK | BLANK | BLANK |
| 15 | 2BAR | 2BAR | 1BAR |
| 16 | BLANK | BLANK | BLANK |
| 17 | 3BAR | 3BAR | SEVEN |
| 18 | BLANK | BLANK | BLANK |
| 19 | 1BAR | 1BAR | 1BAR |
| 20 | BLANK | BLANK | BLANK |
| 21 | 2BAR | 2BAR | 2BAR |
| 22 | BLANK | BLANK | BLANK |

FIG. 4

| | WINNING COMBINATION | | | PAYOUT | | |
|---|---|---|---|---|---|---|
| INDEX | REEL 1 | REEL 2 | REEL 3 | 1 COIN | 2 COIN | MAXBET |
| 1 | PWRPNT | PWRPNT | XFACTOR | Z | 2Z | 2XZ |
| 2 | SEVEN | SEVEN | XFACTOR | 100 | 200 | 200X |
| 3 | SEVEN | SEVEN | SEVEN | 100 | 200 | 200 |
| 4 | 3BAR | 3BAR | XFACTOR | 40 | 80 | 80X |
| 5 | 3BAR | 3BAR | 3BAR | 40 | 80 | 80 |
| 6 | 2BAR | 2BAR | XFACTOR | 20 | 40 | 40X |
| 7 | 2BAR | 2BAR | 2BAR | 20 | 40 | 40 |
| 8 | PWRPNT | ANY | XFACTOR | Y | 2Y | 2XY |
| 9 | ANY | PWRPNT | XFACTOR | Y | 2Y | 2XY |
| 10 | 1BAR | 1BAR | XFACTOR | 10 | 20 | 20X |
| 11 | 1BAR | 1BAR | 1BAR | 10 | 20 | 20 |
| 12 | PWRPNT | PWRPNT | ANY | 6 | 12 | 12 |
| 13 | ANY BAR | ANY BAR | XFACTOR | 5 | 10 | 10X |
| 14 | ANY BAR | ANY BAR | ANY BAR | 5 | 10 | 10 |
| 15 | PWRPNT | ANY | ANY | 3 | 6 | 6 |
| 16 | ANY | PWRPNT | ANY | 3 | 6 | 6 |

FIG. 5A

| MULTIPLIER TABLE 1 | | | |
|---|---|---|---|
| TABLE POSITION | MULTIPLIER VALUE Y1 | TABLE POSITION | MULTIPLIER VALUE Y1 |
| 1 | 6 | 11 | 21 |
| 2 | 6 | 12 | 21 |
| 3 | 9 | 13 | 21 |
| 4 | 15 | 14 | 21 |
| 5 | 15 | 15 | 21 |
| 6 | 15 | 16 | 21 |
| 7 | 15 | 17 | 24 |
| 8 | 15 | 18 | 24 |
| 9 | 18 | 19 | 24 |
| 10 | 21 | 20 | 24 |

FIG. 5B

| MULTIPLIER TABLE 2 | | | |
|---|---|---|---|
| TABLE POSITION | MULTIPLIER VALUE Y2 | TABLE POSITION | MULTIPLIER VALUE Y2 |
| 1 | 6 | 11 | 21 |
| 2 | 9 | 12 | 21 |
| 3 | 9 | 13 | 21 |
| 4 | 12 | 14 | 21 |
| 5 | 15 | 15 | 24 |
| 6 | 15 | 16 | 24 |
| 7 | 15 | 17 | 24 |
| 8 | 15 | 18 | 24 |
| 9 | 15 | 19 | 24 |
| 10 | 18 | 20 | 24 |

FIG. 5C

| MULTIPLIER TABLE 3 | | | |
|---|---|---|---|
| TABLE POSITION | MULTIPLIER VALUE Z | TABLE POSITION | MULTIPLIER VALUE Z |
| 1 | 110 | 11 | 185 |
| 2 | 120 | 12 | 190 |
| 3 | 130 | 13 | 190 |
| 4 | 135 | 14 | 200 |
| 5 | 135 | 15 | 210 |
| 6 | 140 | 16 | 220 |
| 7 | 160 | 17 | 225 |
| 8 | 170 | 18 | 230 |
| 9 | 175 | 19 | 240 |
| 10 | 180 | 20 | 250 |

FIG. 7

| WINNING COMBINATION | | | PROBABILITY | | 1 COIN MODE | | | 2 COIN MODE | | | MAX BET MODE | | |
|---|---|---|---|---|---|---|---|---|---|---|---|---|---|
| | | | | | FORMULA | VALUE | EXPECTED | FORMULA | VALUE | EXPECTED | FORMULA | VALUE | EXPECTED |
| PWRPNT | PWRPNT | XFACTOR | 1/10648 | 9.391E-05 | Z | 180 | 0.0169 | 2Z | 360 | 0.0338 | $2X_2Z$ | 1613 | 0.15153 |
| SEVEN | SEVEN | XFACTOR | 1/10648 | 9.391E-05 | 100 | 100 | 0.0094 | 200 | 200 | 0.0188 | $200X_0$ | 857.9 | 0.08057 |
| SEVEN | SEVEN | SEVEN | 2/10648 | 0.0001878 | 100 | 100 | 0.0188 | 200 | 200 | 0.0376 | 200 | 200 | 0.03757 |
| 3BAR | 3BAR | XFACTOR | 4/10648 | 0.0003757 | 40 | 40 | 0.015 | 80 | 80 | 0.0301 | $80X_0$ | 343.2 | 0.12891 |
| 3BAR | 3BAR | 3BAR | 4/10648 | 0.0003757 | 40 | 40 | 0.015 | 80 | 80 | 0.0301 | 80 | 80 | 0.03005 |
| 2BAR | 2BAR | XFACTOR | 16/10648 | 0.0015026 | 20 | 20 | 0.0301 | 40 | 40 | 0.0601 | $40X_0$ | 171.6 | 0.25782 |
| 2BAR | 2BAR | 2BAR | 48/10648 | 0.0045079 | 20 | 20 | 0.0902 | 40 | 40 | 0.1803 | 40 | 40 | 0.18032 |
| PWRPNT | ANY | XFACTOR | 21/10648 | 0.0019722 | Y | 17.85 | 0.0352 | 2Y | 35.7 | 0.0704 | $2X_1Y$ | 156.9 | 0.30943 |
| ANY | PWRPNT | XFACTOR | 21/10648 | 0.0019722 | Y | 17.85 | 0.0352 | 2Y | 35.7 | 0.0704 | $2X_1Y$ | 156.9 | 0.30943 |
| 1BAR | 1BAR | XFACTOR | 9/10648 | 0.0008452 | 10 | 10 | 0.0085 | 20 | 20 | 0.0169 | $20X_0$ | 85.79 | 0.07251 |
| 1BAR | 1BAR | 1BAR | 36/10648 | 0.0033809 | 10 | 10 | 0.0338 | 20 | 20 | 0.0676 | 20 | 20 | 0.06762 |
| PWRPNT | PWRPNT | ANY | 21/10648 | 0.0019722 | 6 | 6 | 0.0118 | 12 | 12 | 0.0237 | 12 | 12 | 0.02367 |
| ANY BAR | ANY BAR | XFACTOR | 52/10648 | 0.0048835 | 5 | 5 | 0.0244 | 10 | 10 | 0.0488 | $10X_0$ | 42.89 | 0.20948 |
| ANY BAR | ANY BAR | ANY BAR | 560/10648 | 0.052592 | 5 | 5 | 0.263 | 10 | 10 | 0.5259 | 10 | 10 | 0.52592 |
| PWRPNT | ANY | ANY | 441/10648 | 0.0414162 | 3 | 3 | 0.1242 | 6 | 6 | 0.2485 | 6 | 6 | 0.2485 |
| ANY | PWRPNT | ANY | 441/10648 | 0.0414162 | 3 | 3 | 0.1242 | 6 | 6 | 0.2485 | 6 | 6 | 0.2485 |
| | | | EXPECTED PAYOUT | | | | 0.8557 | | | 1.7114 | | | 2.88181 |
| | | | PERCENTAGE PAYOUT | | | | 85.572% | | | 85.572% | | | 96.0602% |

| SPINS | 10 | 100 | 1000 | 2000 | 4000 |
|---|---|---|---|---|---|
| $X_M$ | 2.000411592 | 3.4736886032 | 4.325063673 | 4.326392042 | 4.326399999 |
| $X_0$ | 2.000112135 | 3.435396069 | 4.288096633 | 4.289431186 | 4.289439197 |
| $X_1$ | 2.000926898 | 3.544583195 | 4.393536322 | 4.394853242 | 4.394861101 |
| $X_2$ | 2.003324238 | 3.635782233 | 4.480509684 | 4.481811793 | 4.481819527 |

SLOT MACHINE WITH INCREMENTAL PAY-OFF MULTIPLIER

BACKGROUND OF THE INVENTION

This invention relates to gaming machines. More specifically, it relates to spinning reel type slot machines.

Spinning reel slot machines have maintained their popularity, evolving from electro-mechanical devices to the present day devices which employ microprocessor control. In modern devices, the spinning reels are used merely as a display to advise a player if he has won or lost a game of chance played entirely in a computer memory according to the rules embedded in a computer program. Such machines may have further displays, in addition to the reels, on which other aspects of the game are displayed. In the past, such displays have included "trail games" wherein an indicator proceeds along a board game style trail providing different features. These features might include nudges and gamble features awarding prizes. Such machines have also been known to have a variable jackpot, which increases over time until it is paid out. The variable size jackpot only applies to the maximum payout available.

Whatever theme the game has, it is necessary that the casino owner make a profit, and that the game have player appeal. This is often accomplished by increasing the jackpot gradually over time, so that players feel that they should keep playing to win the larger jackpot. However, a disadvantage of simply increasing the jackpot is that it is very unlikely that a player will win the jackpot, and most players will not risk continuing to play, just to win the jackpot. Also, after a jackpot occurs, players may shun a game because they believe it will not hit again soon or that the initial jackpot value is too small.

SUMMARY OF THE INVENTION

In a first aspect, the present invention is a spinning reel slot machine in which selected payouts are multiplied by a variable value, independent of the winning symbol combination whereby to increase player interest in the game.

In a second aspect, the present invention is a spinning reel slot machine in which all payout values are multiplied by a certain value, independent of the winning symbol combination whereby to increase player interest in the game.

By providing an overall multiplier of the payoff, the player perceives that the overall payout of the machine is higher and that the likelihood of this payout compared to a jackpot payout for example is very high. This would therefore provide a significant incentive for the player to play the game.

The invention provides a spinning reel machine in which selected winning combinations are multiplied by a variable value. The value by which the payout is multiplied increases gradually when certain conditions are met in the course of playing the base game. The value is reset to its initial value after a payout occurs.

By providing such an incremental payout value over a period of time, a player is enticed into remaining at the machine until the payout is made, to win a larger payment. However, by allocating the payout to winning combinations other than the jackpot, a significantly increased probability of winning the variable payout is achieved so that a player is not put off continuing to play the machine. Further, by providing a simple means for altering the payout ratio of the machine, the variable multiplier makes it more straightforward to give the machine any desired payout ratio without changing the reel symbols or the basic payments for each type of win. A simple change to the possible multiplier values which could be achieved by replacing a chip or using a table editing software procedure is all that is required.

The present invention further provides a spinning reel slot machine wherein the prize awarded for combinations of symbols including a special symbol are multiplied by a variable multiplier value. This multiplier value rises in increments whenever certain conditions are met in the outcome of a reel spin. The multiplier value is reset to its initial value when a payout including this symbol occurs.

The present invention further provides a machine in which a counter increases each time a second symbol appears on or near the payline of the reels. Whenever this counter reaches a predetermined value, the multiplier value increases by one, and the counter decreases by the predetermined value.

BRIEF DESCRIPTION OF THE DRAWINGS

FIG. 3 is a table showing three sets of 22 symbols on the three reel strips according to a specific example of a first embodiment of the present invention.

FIG. 4 is a table showing the prizes awarded in the three modes of the example of the first embodiment.

FIGS. 5A, 5B and 5C are tables of values for use in calculating payouts of the specific example of the first embodiment.

FIG. 7 is a table showing the calculation of the expected payoff of the specific example of the first embodiment.

DETAILED DESCRIPTION

Figure 1:
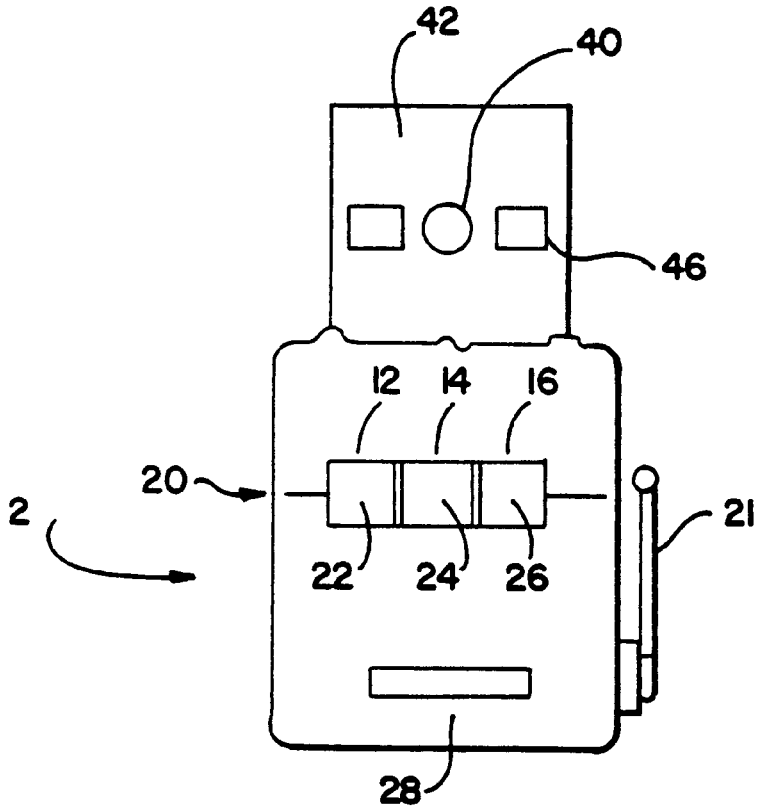
FIG. 1 is a simplified illustration of a spinning reel slot machine according to the preferred embodiments of the present invention.
Figure 2:
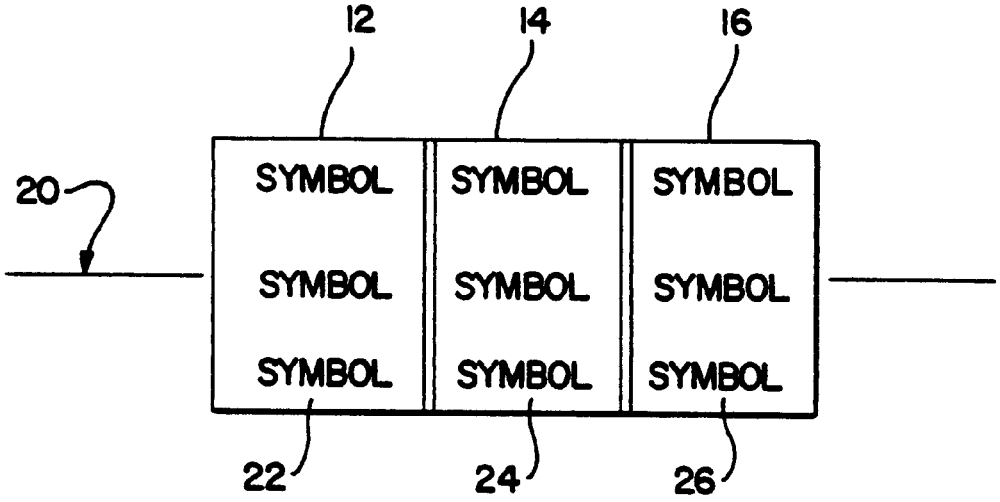
FIG. 2 is an enlargement of the slot machine display showing how symbols appear on, above and below the payline in the preferred embodiments.

FIG. 1 shows an overall view of a first embodiment of the present invention, there is provided a spinning reel slot machine 2 comprising a cabinet 10 having windows 12, 14, 16 on the front which can be viewed by a player standing in front of the machine. As in most spinning reel slot machines, behind the window three reels 22, 24 and 26 are mounted for rotation. A portion of the outer surface of each is reel is visible through the corresponding window as shown in FIG. 2. Each reel has any desired number (usually 22) of symbols thereon, and each window is dimensioned to display three symbols at a time. The reels are each individually driven by a stepper motor which is controlled by a microprocessor as is known in this art. Circuitry is provided so that the microprocessor can send instructions for the reel to spin and to stop at a predetermined position with three symbols showing on pay line 20. Three stepper motors under the control of a microprocessor rotate the reels. Feedback from optical beam breaking mechanisms on each of the reels allows the processor to establish the position of each of the reels and stop them in appropriate position depending on a random value generated by the processing means. As shown in FIG. 2, whenever all the reels are stopped, a three-by-three rectilinear array of symbols is displayed on, above and below payline 20. The row of three symbols across the center of this three by three array is referred to as the pay line, and the symbols appearing on this line determine the prizes paid out as described below. For a typical 22 stop reel, the symbols and frequency of occurrence are selected based on probability analysis. These symbols are designed in an eye-catching manner.

A handle 21 or a switch button is provided on the machine, by which a player can commence cycles of the game.

To operate the game, a player puts coins or bills into the game and the value is determined by the processor and stored in computer memory. The number of credits thus purchased is displayed on another display not shown. Depending on how many modes the game has, different switch buttons are provided to start the game in the appropriate mode.

If sufficient credit has been purchased, the handle 21 can be pulled or the appropriate switch button operated. This commences a cycle of operation of the machine, whereby the reels 22, 24, 26 begin to spin under the control of the game microprocessor. The machine enters the mode corresponding to the number of credits which have been wagered, and deducts the appropriate number of credits from the stored value.

The microprocessor generates one or more random numbers to determine what the result of the cycle will be and causes the reels to stop at the appropriate locations corresponding to the random number selected for each reel. The processor stops the left reel 22 first, followed by the center reel 24 and finally the right reel 26. Typically, the memory contains a look up table representing the symbols shown in FIG. 6. The processor assigns the symbols shown to registers in memory for use in calculating the payout.

When the reels have stopped spinning, the microprocessor decides if the combination is a winning combination, and calculates any payout depending on the symbols showing. A specific example of such a calculation is described later for a specific example of the embodiment. Typically, payouts are all based on multiples of the smallest number of credits needed to play a game. However, some additional inducement may be expressed to encourage multiple credit play. The payout is ether released into a coin discharge trough 28 or added to the stored credits.

A multiplier value X is shown in display 44 which increases as certain predetermined conditions are fulfilled during gameplay as will be described in detail below. This value X has a preselected range, for example, 2 to 10. When a winning combination occurs on the pay line, the normal payout is multiplied by the multiplier value X, and the value of X will normally return to its lowest value.

By providing an increasing multiplier value X, a player has an incentive to continue playing the machine in the hope of winning an increased payout. If the player leaves the machine before such a payoff, the increased value X will be available to the next player who uses the machine.

A specific example of the first embodiment will now be described. It has three modes of play referred to as 1 Coin, 2 Coin and MaxBet modes and requiring 1, 2 and 3 credits, respectively.

The symbols in this example of the second embodiment are:

| | | |
|---|---|---|
| 1BAR | XFACTOR | BLANK |
| 2BAR | POWERPOINT | BLANKHI |
| 3BAR | SEVEN | BLANKLO |

and their distribution on the reel strips is shown in FIG. 3.

Symbols in the first column are referred to generically as BARS, and symbols in the third column are displayed on the reels as a blank but are stored as different symbols in the computer memory.

Three displays 42, 44, 46 are provided on the top front of the cabinet. Display 42 displays "Power Point" information as will be discussed hereafter. Center display 44 shows the value of the Multiplier Value X as will also be discussed hereafter. Right display 46 includes a display which explains the rules of the game.

The normal payout for any winning combination on the payline 20 is shown in the table of FIG. 4. The prize paid out for each of the winning combinations listed in the first column of FIG. 4 is shown in the 1 Coin, 2 Coin and MaxBet columns depending on the mode selected by the player. The game program progressively checks the winning combination against each of the combinations in FIG. 4, starting with the highest paying win at the top of the table and progressing to the lowest paying win at the bottom of the table. The numeric value representing the payout is a multiple of one credit. As can be seen, the XFACTOR symbol counts as a wild card and can replace any BAR or SEVEN symbol in a winning combination, although the XFACTOR symbol has further effects in the MaxBet mode as discussed later in the specification.

The multiplier value X is stored in the memory and shown on the display 44. The value of X is an integer ranging from 2 to 10 and is initialized at a value of 2 when the machine is switched on. The value of X remains constant unless the machine is in the MaxBet mode described later. Further, the X factor does not form part of the payout formula unless the game is in the MaxBet mode.

Three tables, "Multiplier Table 1," "Multiplier Table 2," and "Multiplier Table 3" shown in FIGS. 5A, 5B, and 5C, each having 20 possible values are also stored in the computer memory. The sets of values in the Multiplier Tables 1 and 2 represent possible payout values, Y of the machine when the combination of a single POWERPOINT and a single XFACTOR appear on the Payline, corresponding to indexes 8 and 9 in FIG. 4. These values range from 6 to 24 credits. A random entry from one of these tables is chosen as the amount won by a player in the single coin mode when this combination of symbols is obtained. The award value appears on the right display 46 to inform the player of his winnings. The value of this prize is doubled when the machine is in the second mode. Multiplier Table 1 or 2 is chosen according to the multiplier value X presently displayed on display 44. In particular, Y is chosen from table 1 when the multiplier value X is 4 or more and from Multiplier Table 2 when the multiplier value X is less than 4. While the mean values of the two tables are the same, both being 17.85, there are less sixes in Multiplier Table 2 than in Multiplier Table 1 so that a player is less likely to receive a low value Y when he has a high multiplier value X, giving an incentive to play the game, even in one of the first two modes, when the multiplier value X is high.

Multiplier Table 3 shown in FIG. 5C also contains 20 values, and contains the amount won when the highest winning prize which consists of two POWERPOINTS and one XFACTOR is achieved in one coin mode. Values in this table are chosen randomly whenever such a win occurs. The value of this prize is doubled when the machine is in the two coin code. For example, when the 2 POWERPOINT, 1 XFACTOR combination occurs, the payout is Z or 2Z credits which from Multiplier Table 3 may be 110 up to 250 credits in one coin mode, or 220 to 500 in two coin mode.

When the game is in the MaxBet mode, according to the invention a fundamentally different scoring mechanism comes into effect.

Figure 6A:
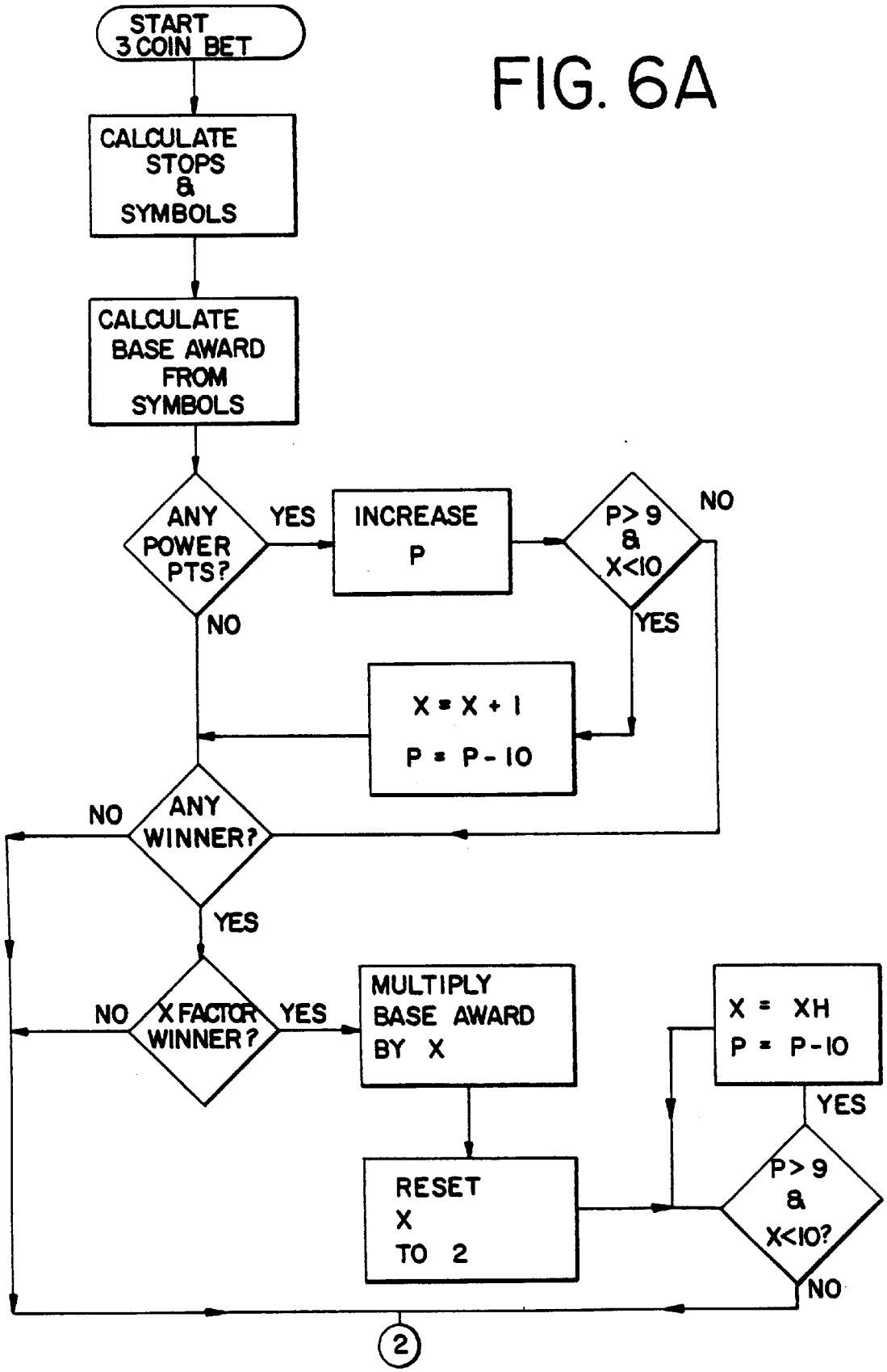
FIGS. 6A and 6B are two parts of a single flowchart representing the operation of the example of the first embodiment in MaxBet mode.
Figure 6B:
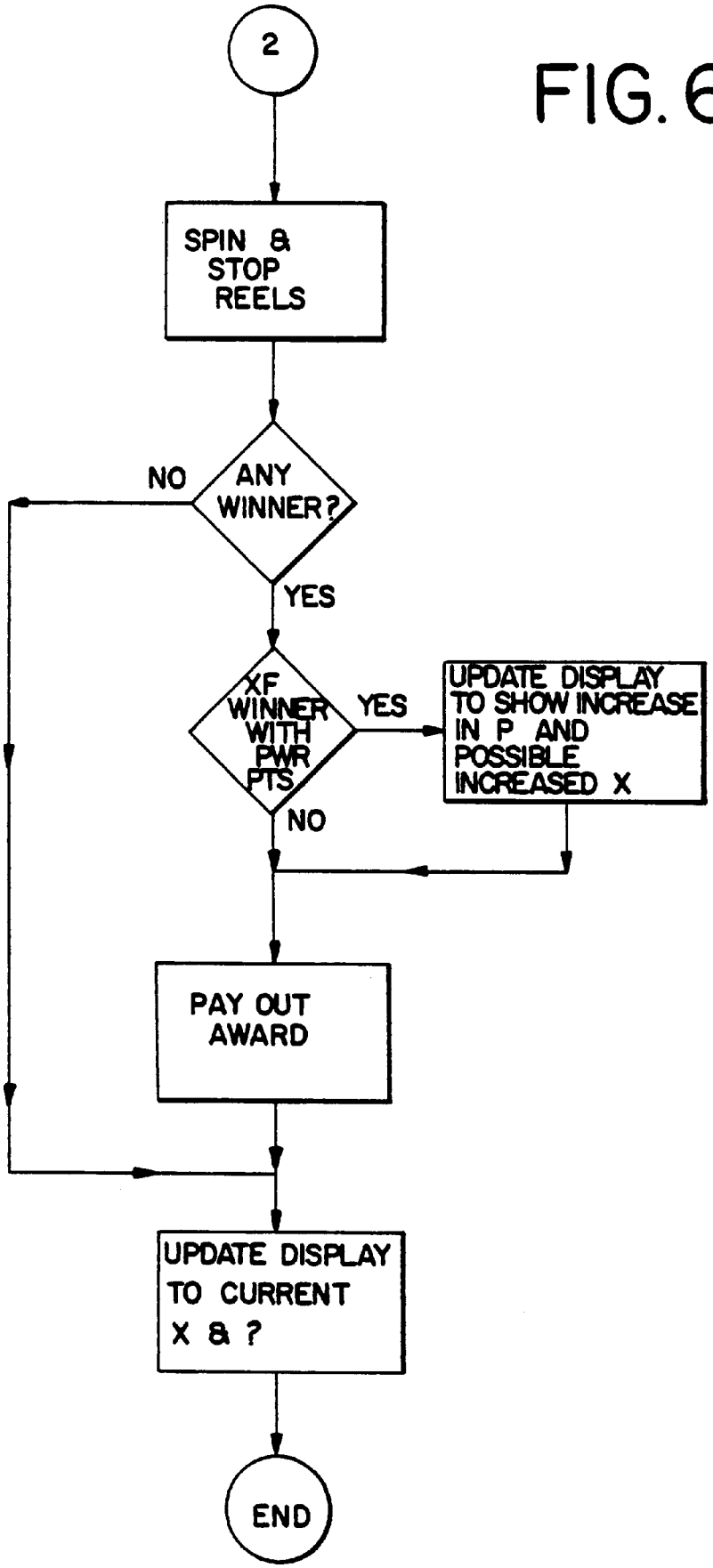

The operation of the machine in this mode is represented by a flowchart which continues from FIG. 6A to FIG. 6B. This flowchart shows the procedure followed by the machine in calculating and displaying the payoff. From the flow chart, the preferred embodiment may be programmed by those skilled in this art in any preferred programming language. Examples include C++ and Assembly language. All the calculations are actually performed before the reels are spun, and the results are stored in a non-volatile memory so they can be displayed after the reels stop. This ensures that a player is not "cheated" by a power failure or other occurrence that can affect the spinning of the reels and the subsequent display of the win and the payout.

The positions where the reels will be stopped are calculated and the base award associated therewith is calculated, which is the award which would be paid out for the same combination in 2 Coin mode. According to an important aspect of the invention, at the end of each spin of the reels in the MaxBet mode, the number of POWERPOINT symbols showing at any of the nine visible symbol positions is added to a sum previously stored in the memory to give a total number P of stored Power Points as shown in FIG. 6A. This value P is initialized to zero when the machine is reset. Whenever the value P increases, an animation is shown on the left display to alert the player to the increase as shown in FIG. 6B. After this animation is finished, and at all other times when this mode is in operation, the total number of Power Points, P, stored is displayed in the left display. When the game leaves the MaxBet mode because a spin has been started in one of the first two modes, the left screen shows a message reminding the player that Power Points are only collected in the MaxBet mode. The value P will remain constant in the first and second modes even if POWERPOINT symbols appear in the nine visible locations.

For every ten Power Points that are achieved in the MaxBet mode, the Multiplier Value X is increased by one as shown in FIG. 6A. An animation is then shown representing the increase of the multiplier value X as shown in FIG. 6B. At this point, the stored number of Power Points is reduced by 10 as shown in FIG. 6A.

Increasing of the value X in MaxBet mode occurs until it reaches a maximum value 10, or an XFACTOR payout occurs as described below. When X reaches 10, the value does not increase any further when P reaches 10. Instead P continues to increases as Power Points are gained, as shown in FIG. 6A. The right screen displays a message stating that the multiplier value is at its maximum, and that Power Points will now be stored and are shown on the right display.

The procedure followed when a win occurs in the Max Bet mode will now be described.

If a winning combination is obtained on the payline in MaxBet mode, the right display provides a message stating the amount of the win. If one of the three symbols in the payline is an XFACTOR symbol, as shown at index 1, 2, 4, 6, 8, 9, 10, or 13 in FIG. 4, the listed amount paid out is multiplied by the value X, otherwise the listed amount is paid out.

If an XFACTOR payout occurs, the value of X is decreased to 2. If less than 10 Power Points were stored, these Power Points are retained. If 10 or more Power Points were stored, the multiplier value X will be increased from 2 by one for every 10 Power Points, and the value P will be reduced by 10 accordingly as shown in FIG. 6A.

After the payout occurs, an animation is played in the right display showing the amount won. Then, the new initial value of X, 2 is displayed. The right display will display a "Stored points activated" animation. The left display will then show the remaining balance of Power Points. If more than 80 Power Points were stored (which would raise the multiplier value X back to a maximum of 10), the Power Points above 80 would continue to be stored. With the arrangement of symbols shown in the table in FIG. 3, it takes on average 293 spins of the reels to amass 80 Power Points, and an XFACTOR payout occurs on average every 85 spins of the reels, so statistically it will be rare (but possible) for the stored Power Points to rise over 80, or even for the multiplier value X to reach ten.

The calculations for the predicted payoff of the machine are shown in the table in FIG. 7. In the columns under the heading "Probability", the probabilities of each payoff occurring are shown, firstly as a fraction and then as a decimal. The table also contains payout information for each mode. For each mode, the first column contains the formula for calculating the payoff. The second column shows the formula with values inserted for the expected values for the multiplier values X, Y and Z. The third column contains the expected payoff for each of the winning combinations per spin, and is calculated by multiplying the probability of the combination occurring and the expected value of that win. The sum of this column, shown at the foot of the column, is the expected payout for each mode per spin.

It should be noted that the calculation of the expected value of an XFACTOR win is complicated due to the non linearity of the progression of the multiplier value X. The following equations relating to this calculation are believed to be correct, and to reflect the operation of the machine as described above. In any case, the desired factors can be developed empirically. In order to simplify calculation of this value, another value Q is defined:

$$Q=P+10(X-2) \qquad \text{(Eqn 1)}$$

This value Q is similar to P, but does not decrease by 10 every time the Multiplier value X increases by 1. It can be seen that for each Power Point scored, Q will rise by 1. For values of Q from 0 to 9, X will be 2. For values of Q from 10 to 19, X will be 3, and so on. For values of Q above 80, X will always be 10. The Multiplier Value X for any value of Q is shown as a stepped line in FIG. 8.

Whenever an XFACTOR win occurs, Q will increase to add all the power points awarded on that spin, and will then either fall by 80 if Q is greater than or equal to 80, or will fall to Q MOD 10 if Q is less than 80, where MOD represents the remainder on division. For example, if X was 5 and P was 4 (Q=34), X would fall to 2 and P would remain at 4 (Q=4).

The probability of the machine being in any particular state Q varies with the number of spins. Clearly, before the first spin, Q must have a value of 0, as the machine starts in a state with no Power points P and an X Factor of 2. After 1 spin, Q is either 0, 1 or 2, depending on the number of POWERPOINTS in the three by three symbol array after that spin. The probability p(Q, t) of the machine being in any particular state Q after a predetermined number of spins t can be calculated iteratively. First, the following six probabilities are defined which are mutually exclusive and cover all possibilities for the result of a reel spin:

$$p_1 = \frac{197}{10648} = \text{prob(No XFACTOR win, 2 POWERPOINTS visible)} \quad \text{(Eqn 2)}$$

$$p_2 = \frac{2466}{10648} = \text{prob(No XFACTOR win, 1 POWERPOINT visible)} \quad \text{(Eqn 3)}$$

$$p_3 = \frac{7860}{10648} = \text{prob(No XFACTOR win, 0 POWERPOINTS visible)} \quad \text{(Eqn 4)}$$

$$p_4 = \frac{5}{10648} = \text{prob(XFACTOR win, 2 POWERPOINTS visible)} \quad \text{(Eqn 5)}$$

$$p_5 = \frac{38}{10648} = \text{prob(XFACTOR win, 1 POWERPOINT visible)} \quad \text{(Eqn 6)}$$

$$p_6 = \frac{82}{10648} = \text{prob(XFACTOR win, 0 POWERPOINTS visible)} \quad \text{(Eqn 7)}$$

The probability p(Q,t) is then defined as follows:

| | | |
|---|---|---|
| $t < 0$ OR $Q < 0$ | (Eqn 8) | $p(Q,t) = 0$ |
| $t = 0$ AND $Q = 0$ | (Eqn 9) | $p(Q,t) = 1$ |
| $t = 0$ AND $Q > 0$ | (Eqn 10) | $p(Q,t) = 0$ |
| $t > 0$ AND $0 \leqq Q \leqq 9$ | (Eqn 11) | $p(Q,t) = (p_1 + p_4)p(Q-2, t-1) + (p_2 + p_5)p(Q-1, t-1) + (p_3 + p_6)p(Q, t-1) + \sum_{i=0}^{7} p_4 p(Q + 10i + 8, t-1) + p_5 p(Q + 10i + 9, t-1) + p_6 p(Q + 10i + 10, t-1)$ |
| $t > 0$ AND $10 \leqq Q \leqq \infty$ | (Eqn 12) | $p(Q,t) = p_1 p(Q-2, t-1) + p_2 p(Q-1, t-1) + p_3 p(Q, t-1) + p_4 p(Q+78, t-1) + p_5 p(Q+79, t-1) + p_6 p(Q+80, t-1)$ |

Essentially, equation 11 states that the probability of the machine being in state Q, where Q<10 (ie Multiplier X=2 and P=Q) after a spin is the sum of:

i) the probability of the machine being in state Q-2 before the spin and 2 Power Points being scored, whether or not an XFACTOR win. (Q increases by 2).

ii) the probability of the machine being in state Q-1 before the spin and obtaining 1 Power Point, whether or not an XFACTOR win (Q increases by 1).

iii) the probability of the machine being in state Q before the spin and obtaining 0 Power Points, whether or not an XFACTOR win (Q stays the same).

iv) the probability of the machine being in state Q+8, Q+18 . . . or Q+78 before the spin, receiving an XFACTOR win and obtaining 2 power points.

v) the probability of the machine being in state Q+9, Q+19 . . . or Q+79 before the spin, receiving an XFACTOR win and obtaining 1 power point.

vi) the probability of the machine being in state Q+10, Q+20 . . . or Q+80 before the spin, receiving an XFACTOR win and obtaining 0 power points.

Equation 12 states that the probability of the machine being in state Q, where Q is 10 or more after a spin is the sum of:

i) the probability of the machine being in state Q-2 before the spin and not obtaining an XFACTOR win and having two POWERPOINT symbols visible (Q raises by 2).

ii) the probability of the machine being in state Q-1 before the spin and not obtaining an XFACTOR win and having one POWERPOINT symbol visible (Q raises by 1).

iii) the probability of the machine being in state Q before the spin and not obtaining an XFACTOR win and having no POWERPOINT symbols visible (Q stays the same).

iv) the probability of the machine being in state Q+78 before the spin and obtaining an XFACTOR win and having two POWERPOINT symbols visible (Q decreases by 78).

v) the probability of the machine being in state Q+79 before the spin and obtaining an XFACTOR win and having one POWERPOINT symbol visible (Q decreases by 79).

vi) the probability of the machine being in state Q+80 before the spin and obtaining an XFACTOR win and having no POWERPOINT symbols visible (Q decreases by 80).

Once t gets large, this function converges so that p(Q,t+1)-p(Q,t) giving a function p(Q) which rises approximately as a straight line to Q =9 and then tails off smoothly. Thus, once t is large, there is an almost constant probability of the machine being in a particular state Q.

Figures 8, 9:
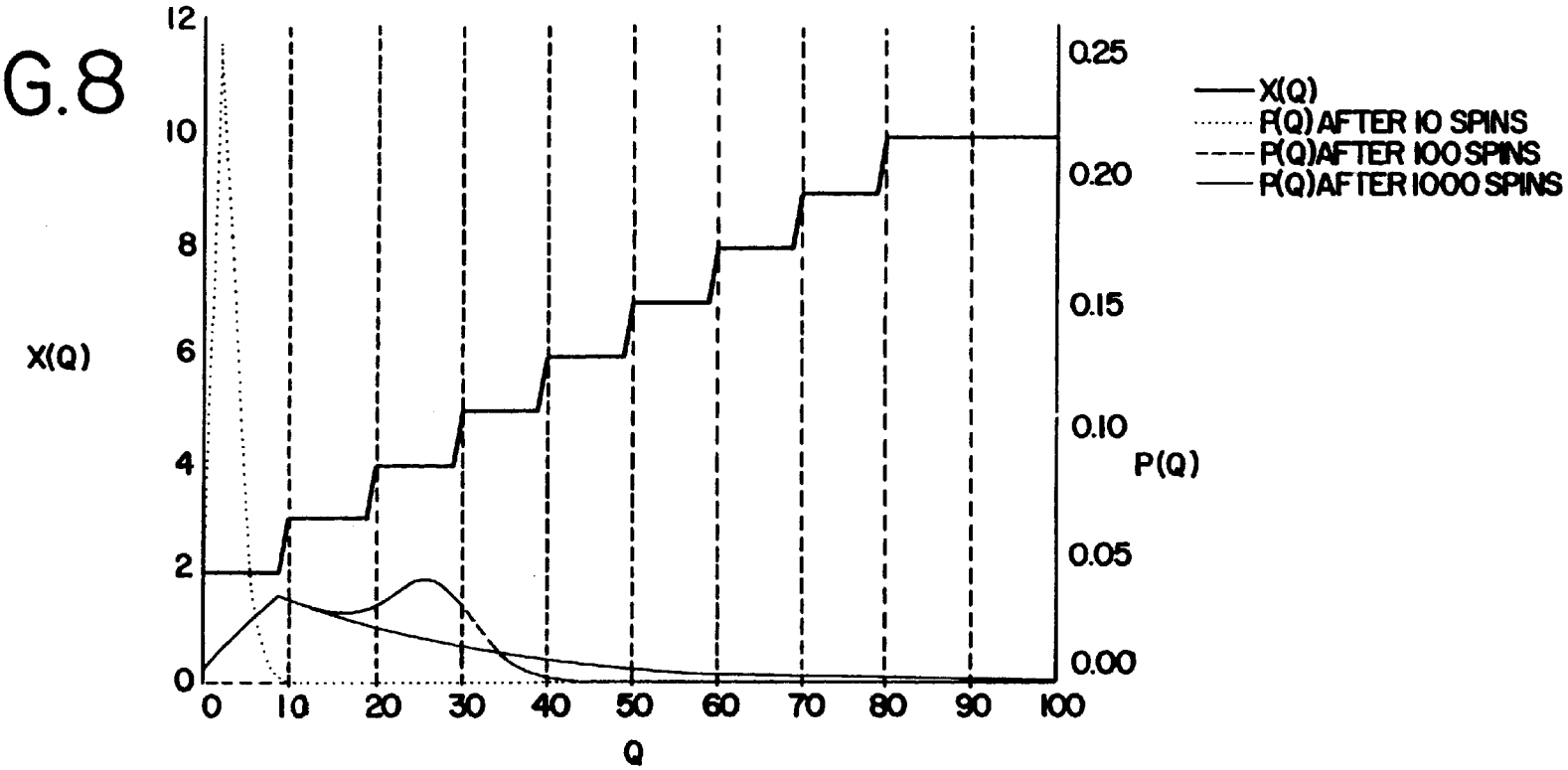
FIG. 8 is a graph showing values probabilities of the machine being in any particular state Q after variuos number of spins, and the associated multiplier value X.
FIG. 9 is a table showing how the expected value of the multiplier X varies with the number of spins.

The values shown in the three curves in FIG. 8 are the probability distributions for Q after 10, 100, and 1000 spins. The area under each of these graphs is 1. The expected multiplier value X for an XFACTOR win which does not include POWERPOINTS (eg. 2 BARS and an XFACTOR symbol) is simply $$X_0 = \sum_{Q=0}^{Q=\infty} p(Q)X(Q) \quad \text{(Eqn 13)}$$

where p(Q) is the probability of having that value of Q before the reels spin, and X(Q) is the multiplier X associated with that value of Q. The expected multiplier value X for an XFACTOR win which does not include POWERPOINTS (the combinations in rows 2, 4, 6, 10 and 13 in FIG. 4) converges on 4.289.

However, the expected value of X for XFACTOR payouts with POWERPOINT symbols in the pay line is higher than the expected value for XFACTOR wins with no POWERPOINT symbols in the pay line. This is because the number of power points P, and hence the value of Q will always have been increased by one or two just before the payoff, so that the payouts will move up to the next multiplier value X approximately 10% of the time when one PowerPoint is in the win line, and approximately 20% of the time when two POWERPOINTS are in the win line. This therefore increases the expected multiplier value X by approximately 0.1 for a single POWERPOINT XFACTOR win, and by 0.2 for a double POWERPOINT XFACTOR win. These values are calculated as follows:

$$X_1 = \sum_{Q=0}^{Q=\infty} p(Q)\left(\frac{19}{21}X(Q+1) + \frac{2}{21}X(Q+2)\right) \quad \text{(Eqn 14)}$$

-continued $$X_2 = \sum_{Q=0}^{Q=\infty} p(Q)X(Q+2) \quad \text{(Eqn 15)}$$

and converge on values 4.39 and 4.48 respectively. It should be noted that there is a 2/21 chance of actually getting two POWERPOINT symbols in the 3×3 array while only getting a 1 POWERPOINT XFACTOR win, (ie one POWERPOINT on the pay line, one POWERPOINT off the payline). This accounts for the added complexity of equation 14.

The predicted values $X_0$, $X_1$, $X_2$, for the 3 different types of XFACTOR payout after 10, 100, 1000, 2000 and 4000 spins are shown in the table in FIG. 9. The mean predicted multiplier value X, $X_M$ when a payout occurs is also shown, and is calculated as follows:

$$X_M = \frac{82}{125}X_0 + \frac{42}{125}X_1 + \frac{1}{125}X_2 \quad \text{(Eqn 16)}$$

This value actually has no relevance to the calculation of the payoff, but is shown for clarity. The predicted values of $X_0$, $X_1$, $X_2$ used in the expected payoff calculations in FIG. 7 are for the approximately steady state after 4000 spins.

An attract mode is also provided which is entered after a period of approximately 50 seconds has elapsed with no gameplay, although this value could clearly be changed. The multiplier value X and number of Power Points stored is retained for use by the next player. This gives an incentive for a player to remain playing on the machine until achieving an X Factor win, otherwise the next player will reap the reward of the increased multiplier value X which the first player has effectively paid for.

In modifications of this example of the first embodiment, different values for the prizes and different symbols on the reels could be used. More reels, could be provided to provide more combinations, or more symbols could be provided on each reel. Extra features, such as nudges and holds, well known in the art could also be added to enhance gameplay.

What is claimed is:

1. A slot machine including a set of spinning reels having a plurality of symbols thereon, means for spinning and stopping said reels to display symbols, means for paying out prizes, and a processor operating according to a game program for controlling the spinning means and which defines a multiplier which sequentially increases in value, winning symbol combinations and standard prize amounts therefor, said processor including:

a) means for randomly selecting symbols to be displayed by said spinning reels;

b) means for determining if a winning combination has been selected for display and if a multiplier symbol is included in said winning combination; and c) means for calculating the prize to be awarded for said winning combinations based on the standard prize amounts multiplied by said variable multiplier, if the winning symbol combination includes said multiplier symbol.

2. A spinning reel slot machine according to claim 1 wherein said processor includes means for decreasing said muliplier value after the occurrence of a winning symbol combination involving said multiplier symbol.

3. A spinning reel slot machine according to claim 1 wherein said processor includes means for sequentially increasing said multiplier from an initial value thereby increasing the potential prize which may be paid out.

4. A spinning reel slot machine according to claim 3 wherein said processor further includes means for decreasing said muliplier to said initial value after the occurrence of a winning symbol combination involving said multiplier symbol.

5. A spinning reel slot machine according to claim 3 wherein said means for sequentially increasing said multiplier includes means for incrementing a counter variable each time a special symbol is selected for display; and means for incrementing said multiplier and resetting said counter variable to an initial value each time said counter variable reaches a predetermined value.

6. A method of operating a slot machine, said machine including a set of spinning reels having a plurality of symbols thereon, means for spinning and stopping said reels to display symbols and a processor, operating according to a game program which defames a multiplier which sequentially increases in value, winning symbol combinations and standard prize amounts therefor, said method comprising the steps of:

a) randomly selecting the symbols to be displayed;

b) determining if a winning symbol combination has been selected for display and if a multiplier symbol is included in said winning symbol combination;

c) calculating the prize to be awarded for a winning symbol combination based on the standard prize amounts multiplied by said multiplier, if the winning symbol combination includes said multiplier symbol;

d) spinning and stopping said reels to display the selected symbols;

e) paying out the prize, if any.

7. The method of claim 6 further comprising the step of decreasing said multiplier after the occurrence of a winning symbol combination involving said multiplier symbol.

8. The method of claim 6 further comprising the steps of:

incrementing said multiplier from an initial value as a function of the symbols selected for display, thereby increasing the potential prize which may be paid out.

9. The method of claim 8 further comprising the steps of:

decreasing said variable multiplier to said initial value after a prize payout involving a winning symbol combination including said multiplier symbol.

10. The method of claim 8 wherein the step of incrementing said multiplier includes the substeps of:

incrementing a counter variable each time a special symbol is selected for display;

incrementing said variable multiplier each time said counter variable reaches a predetermined value; and resetting said counter variable to an initial value.

11. A slot machine including a set of spinning reels having a plurality of symbols thereon, means for spinning and stopping said reels to display symbols, means for paying out prizes, and a processor operating according to a game program for controlling the spinning means and which defames a variable multiplier, winning symbol combinations and standard prize amounts therefor, said processor including:

a) means for randomly selecting symbols to be displayed by said spinning reels;

b) means for determining if a winning combination has been selected for display and if a multiplier symbol is included in said winning combination;

c) means for calculating the prize to be awarded for said winning combinations based on the standard prize amounts multiplied by said variable multiplier, if the winning symbol combination includes said multiplier symbol; and d) means for increasing said variable multiplier from an initial value as a function of the symbols selected for display, thereby increasing the potential prize which may be paid out.

12. A spinning reel slot machine according to claim 11 wherein said processor includes means for decreasing said variable muliplier after the occurrence of a winning symbol combination involving said multiplier symbol.

13. A spinning reel slot machine according to claim 11 wherein said means for increasing said variable multiplier includes:

means for incrementing a counter variable each time a special symbol is selected for display; and means for incrementing said variable multiplier and resetting said counter variable to an initial value each time said counter variable reaches a predetermined value.

14. A method of operating a slot machine, said machine including a set of spinning reels having a plurality of symbols thereon, means for spinning and stopping said reels to display symbols and a processor, operating according to a game program which defines a variable multiplier, winning symbol combinations and standard prize amounts therefor, said method comprising the steps of:

a) randomly selecting the symbols to be displayed;

b) determining if a winning symbol combination has been selected for display and if a multiplier symbol is included in said winning symbol combination;

c) calculating the prize to be awarded for a winning symbol combination based on the standard prize amounts multiplied by said variable multiplier, if the winning symbol combination includes said multiplier symbol;

d) incrementing said variable multiplier from an initial value as a function of the symbols selected for display, thereby increasing the potential prize which may be paid out;

e) spinning and stopping said reels to display the selected symbols;

f) paying out the prize, if any.

15. The method of claim 14 further comprising the step of decreasing said variable multiplier after the occurrence of a winning symbol combination involving said multiplier symbol.

16. The method of claim 14 wherein the step of incrementing said variable multiplier includes the substeps of:

incrementing a counter variable each time a special symbol is selected for display;

incrementing said variable multiplier each time said counter variable reaches a predetermined value; and resetting said counter variable to an initial value.

* * * * *